US010247034B2

(12) United States Patent
Papple et al.

(10) Patent No.: US 10,247,034 B2
(45) Date of Patent: Apr. 2, 2019

(54) TURBINE VANE REAR INSERT SCHEME

(71) Applicant: Pratt & Whitney Canada Corp., Longueuil (CA)

(72) Inventors: Michael Papple, Verdun (CA); Larry Lebel, Vercheres (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 519 days.

(21) Appl. No.: 14/813,585

(22) Filed: Jul. 30, 2015

(65) Prior Publication Data

US 2017/0030218 A1 Feb. 2, 2017

(51) Int. Cl.
*F01D 25/12* (2006.01)
*F01D 9/04* (2006.01)

(52) U.S. Cl.
CPC ..... *F01D 25/12* (2013.01); *F01D 9/041* (2013.01); *F05D 2220/32* (2013.01); *F05D 2240/123* (2013.01); *F05D 2240/124* (2013.01); *F05D 2260/201* (2013.01); *F05D 2260/202* (2013.01); *F05D 2260/22141* (2013.01)

(58) Field of Classification Search
CPC . F01D 5/188; F01D 25/12; F01D 5/18; F01D 5/187; F01D 5/189
See application file for complete search history.

(56) References Cited

U.S. PATENT DOCUMENTS 4,153,386 A 5/1979 Leogrande et al.
5,711,650 A 1/1998 Tibbott et al.
8,662,844 B2 3/2014 Hada et al.
9,011,077 B2 * 4/2015 Vitt ..... F01D 5/186 415/115

FOREIGN PATENT DOCUMENTS

WO WO 2015/012918 1/2015

* cited by examiner

*Primary Examiner* — Jason D Shanske
*Assistant Examiner* — John S Hunter, Jr.
(74) *Attorney, Agent, or Firm* — Norton Rose Fulbright Canada LLP

(57) ABSTRACT

An internally cooled turbine vane for a gas turbine engine has coolant flow channels between the interior walls of the vane and an insert, where the channels serve to convey a portion of the cooling air flow from a pressure side chamber to a suction side chamber. The turbine vane defines a radially extending passage with a dividing wall defining a front section and a rear section; the rear section having interior walls spaced apart from an insert to define the pressure side chamber and the suction side chamber. The insert may receive cooling air and conveys the cooling air into the pressure side chamber and the suction side chamber. A front surface of the insert or a rear surface of the dividing wall may have a clearance gap and an air flow channel communicating between the pressure side chamber and the suction side chamber.

22 Claims, 7 Drawing Sheets

TURBINE VANE REAR INSERT SCHEME

TECHNICAL FIELD

The application relates to an internally air cooled turbine airfoil for a gas turbine engine having air flow channels between the interior walls of the airfoil and an insert.

BACKGROUND OF THE ART

Gas turbine engine design strives for efficiency, performance and reliability. Efficiency and performance enhancement result from elevated combustion temperatures that increase thermodynamic efficiency, specific thrust and maximizes power output. Higher gas flow temperatures also increase thermal and mechanical loads, particularly on the turbine airfoils exposed to combustion gases. Higher thermal and mechanical loads result from higher gas flow temperatures and tend to reduce service life, reduce reliability of airfoils, and increase the operational costs associated with maintenance and repairs.

Therefore, there continues to be a need for efficient cooling schemes, for turbine airfoils to deal with high gas temperatures, that can be fine tuned and adapted to specific problem areas preferably with minimal changes to established design, manufacturing processes, replacement parts and maintenance protocols.

SUMMARY

In one aspect, there is provided a turbine vane comprising: a pressure side; a suction side; and a hollow front section and a hollow rear section separated by a dividing wall; the rear section having interior walls spaced apart from an insert with protrusions to define a pressure side chamber and a suction side chamber; the insert adapted to be connected in communication with a source of pressurized cooling air and including openings for conveying cooling air into the pressure side chamber and the suction side chamber; a front surface of the insert and a rear surface of the dividing wall being spaced apart defining a gap; and at least one of: the front surface of the insert; and the rear surface of the dividing wall, including a channel communicating between the pressure side chamber and the suction side chamber.

In another aspect, there is provided an internally cooled turbine vane comprising: a pressure side; a suction side; and a radially extending passage defined between the pressure side and the suction side; an insert received in the radially extending passage and defining therewith a pressure side chamber and a suction side chamber; at least one channel communicating between the pressure side chamber and the suction side chamber; and means for directing a portion of a coolant within the pressure side chamber through the at least one cooling flow channel to the suction side chamber by a pressure differential between the pressure and suction side chambers.

DETAILED DESCRIPTION

Figure 1:
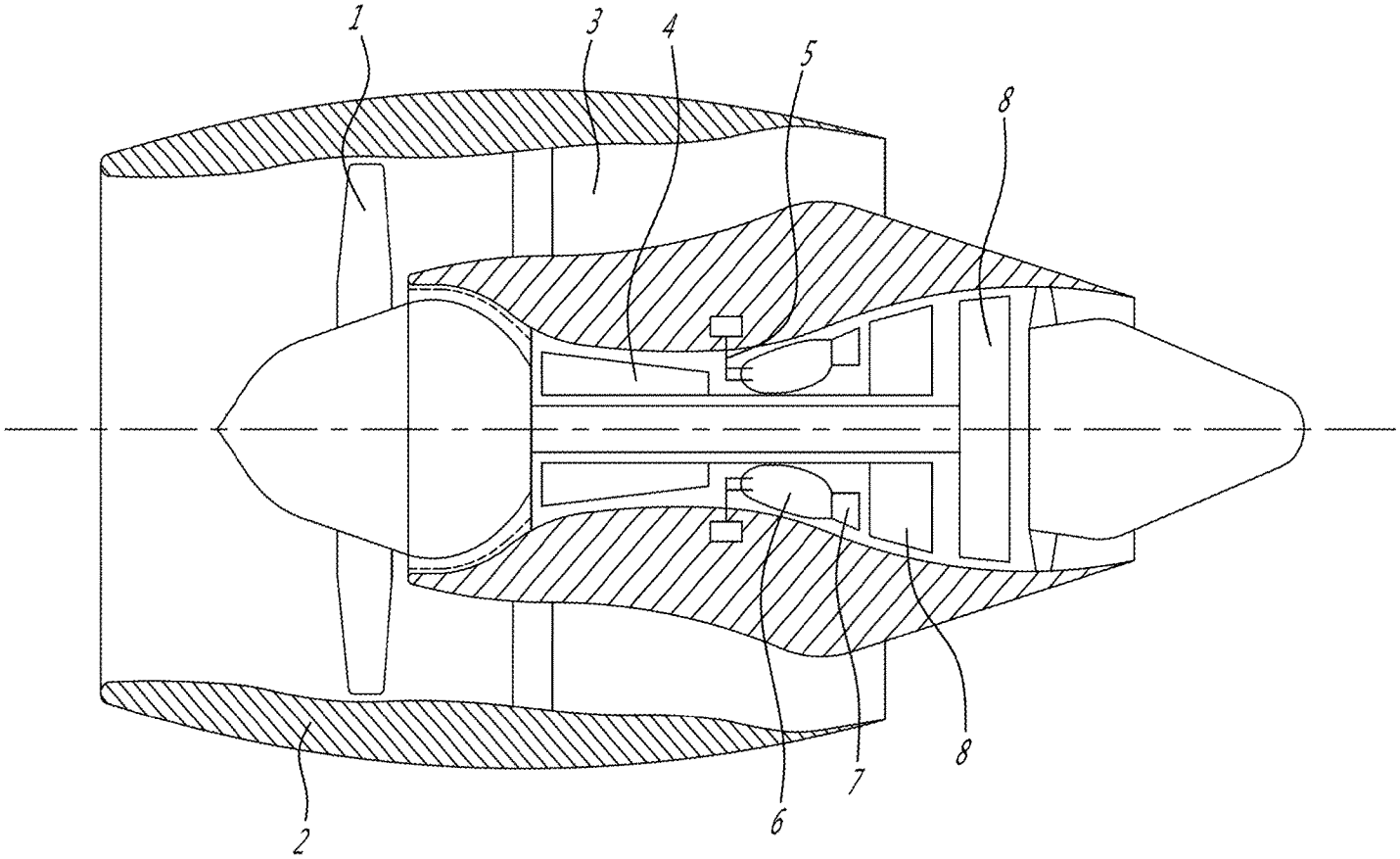
FIG. 1 is a schematic axial cross-sectional view through a turbofan gas turbine engine to specify the location and function of the air cooled nozzle guide vanes.

FIG. 1 shows an axial cross-section through an example turbo-fan gas turbine engine. It will be understood that the invention is equally applicable to any type of engine with a combustor and turbine section such as a turbo-shaft, a turbo-prop, or auxiliary power units.

Air intake into the engine passes over fan blades 1 in a fan case 2 and is then split into an outer annular flow through the bypass duct 3 and an inner flow through the axial compressor 4. Compressed air mixes with fuel fed through fuel tubes 5 and supplied to the combustor 6. The fuel is mixed in a fuel air mixture within the combustor 6 and and is ignited. Hot gases from the combustor 6 pass over the nozzle guide vanes 7 and turbines 8 before exiting the rear of the engine as exhaust. A portion of the compressed air generated by the compressor 4 is ducted as cooling air flow to the interior of the engine including the nozzle guide vanes 7, used for impingement cooling and air film cooling of the vanes 7 before ultimately mixing with the combustion gases before being exhausted from the engine.

Figure 2:
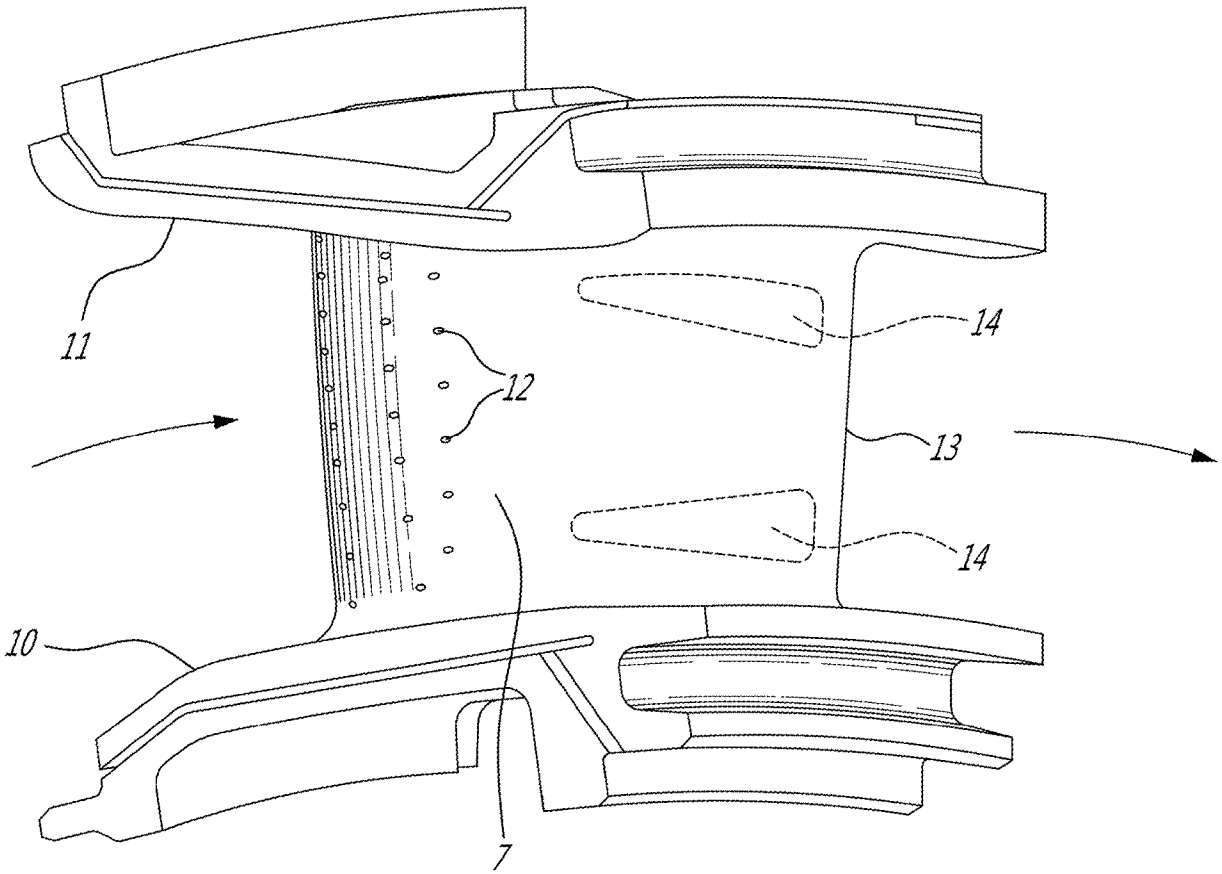
FIG. 2 is a side view of a turbine vane showing gas flow left to right and dashed lines indicating areas exposed to relatively lower gas path temperatures.

FIG. 2 shows the suction side of a turbine vane 7 with radially inner platform 10 and radially outer platform 11 directing hot gas flow as indicated by the arrows. At the leading edge of the vane 7 are openings 12 that provide pressurized cooling air from the interior of the vane 7 to create a cooling air film over the exterior surfaces of the vane 7. At the trailing edge 13 cooling air from the interior of the hollow vane 7 is ejected and mixes with the hot combustion gas flow. The combination of cooling air flow and hot combustion gas flow over the vane 7 and platforms 10, 11 creates areas 14 where the gas path temperature is lower relative to the central areas on the suction side surface of the vane 7.

Figure 3:
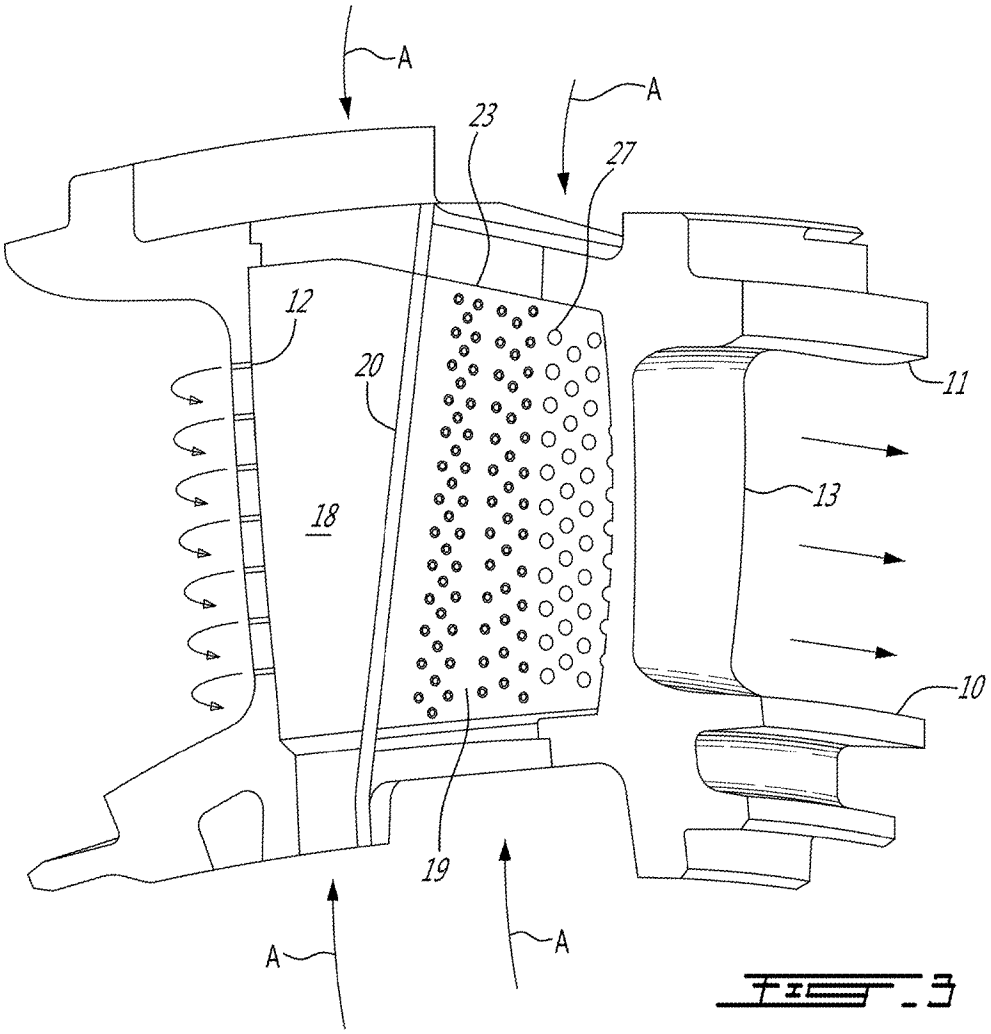
FIG. 3 is a sectional view through the hollow vane of FIG. 2 showing the radial entry of cooling air flow into the rear section with stand-off protrusions to space the insert (see FIG. 4) from the internal walls of the rear section, and pedestals upstream of the trailing edge where air exits the vane.
Figure 4:
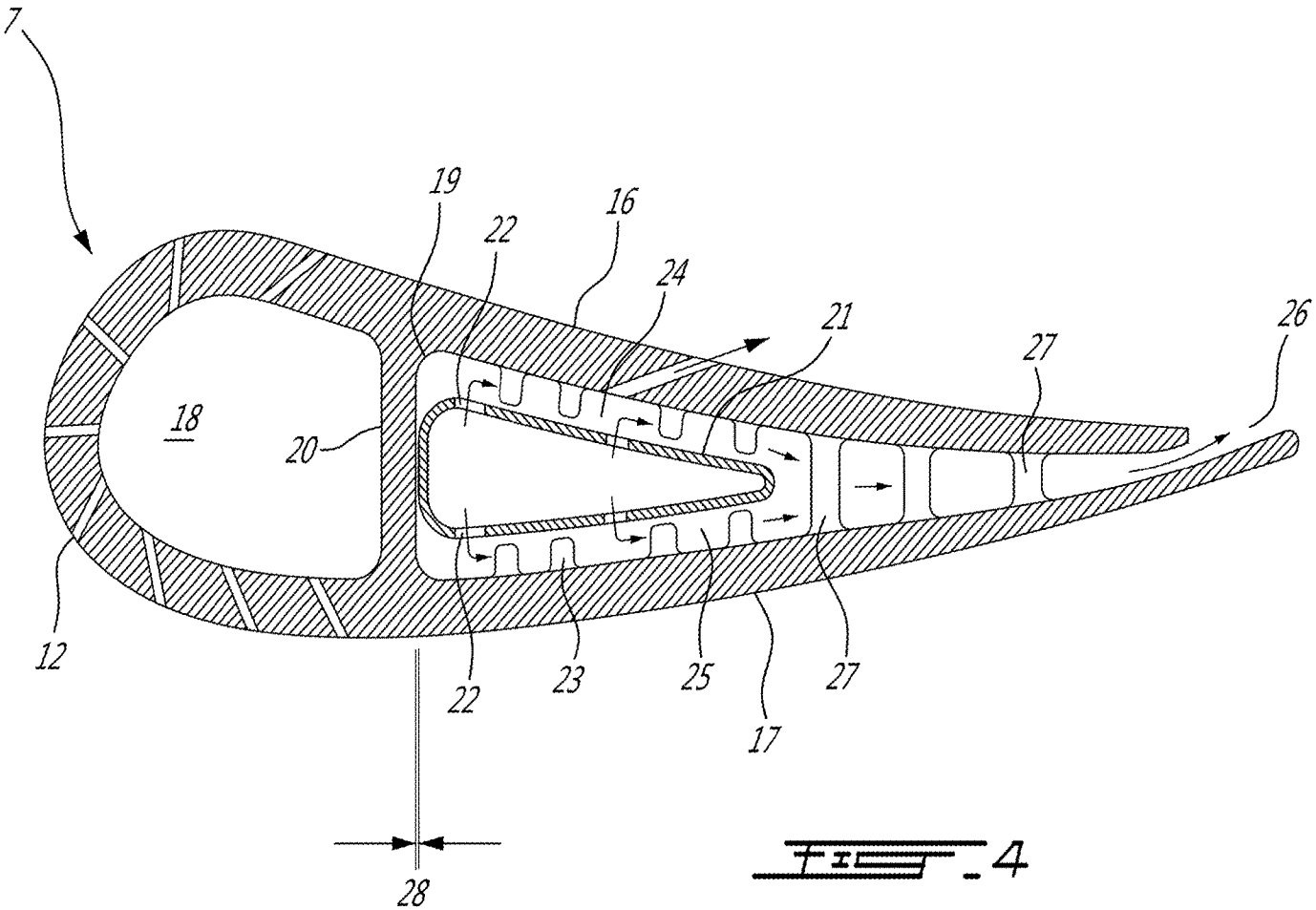
FIG. 4 is a transverse-axial sectional view through the hollow vane of FIG. 2 showing the generally triangular insert within the rear section of the vane with protrusions spacing the insert from the internal walls of the rear section and pedestals spanning across the downstream channel to direct cooling air through the trailing edge exit slot.

FIGS. 3 and 4 illustrate a cooling method. FIG. 4 shows a transverse-axial section through the hollow turbine vane 7 having a concave pressure side 16, a convex suction side 17, and a hollow air cooled interior radially extending passage divided into a front section 18 and a rear section 19 by a dividing wall 20. FIG. 3 shows cooling air with arrows A entering the front section 18 and rear section 19 from radially inward and outward sources of compressed air. FIG. 4 illustrates an insert 21 (not seen in FIG. 3 for clarity) that receives the incoming pressurized cooling air within the interior of the insert 21. The insert 21 has impingement cooling openings 22 that direct air at the interior walls of the rear section 19. The interior walls of the rear section 19 are spaced apart from the insert 21 with stand-offs or protrusions 23 to define a pressure side chamber 24 and a suction side chamber 25 within the rear section 19. The pressure side chamber 24 and the suction side chamber 25 communicate downstream with the gas path via a trailing edge outlet 26. Between the impingement cooling openings 22 and the trailing edge outlet 26, the cooling air circulates around the pressure side chamber 24 and the suction side chamber 25, and passes over the protrusions 23 and pedestals 27. As indicated in FIGS. 3-4, the cooling air flow passing over the protrusions 23 and pedestals 27 contributes to thermal exchange thereby cooling the solid vane walls on the pressure side 16 and suction side 17 of the vane 7 and transferring heat to the air flow.

In the example of FIGS. 3-4, the air pressures within the pressure side chamber 24 and within the suction side chamber 25, are determined by the air pressure within the insert 21, the size/distribution/number of impingement openings 22, the resistance to air flow over the protrusions 23, pedestals and the side walls of the passage upstream of the trailing edge outlet 26.

To summarize, the insert 21 has exterior walls defining an inner passage in communication with a source of pressurized cooling air. The exterior walls of the insert 21 including openings 22 for conveying impingement cooling air into the pressure side chamber 24 and the suction side chamber 25. As indicated in FIG. 4, to accommodate manufacturing tolerances and variations, the front surface of the insert 21 and the rear surface of the dividing wall 20 are spaced apart defining a gap 28. The size of the gap 28 is minimal or may be interference fit, for example 0.0 to 0.005 inches, and merely provides sufficient clearance for manufacturing tolerances. Otherwise the gap 28 restricts and impedes air flow which is preferentially directed downstream towards the trailing edge outlet 26.

Figure 5:
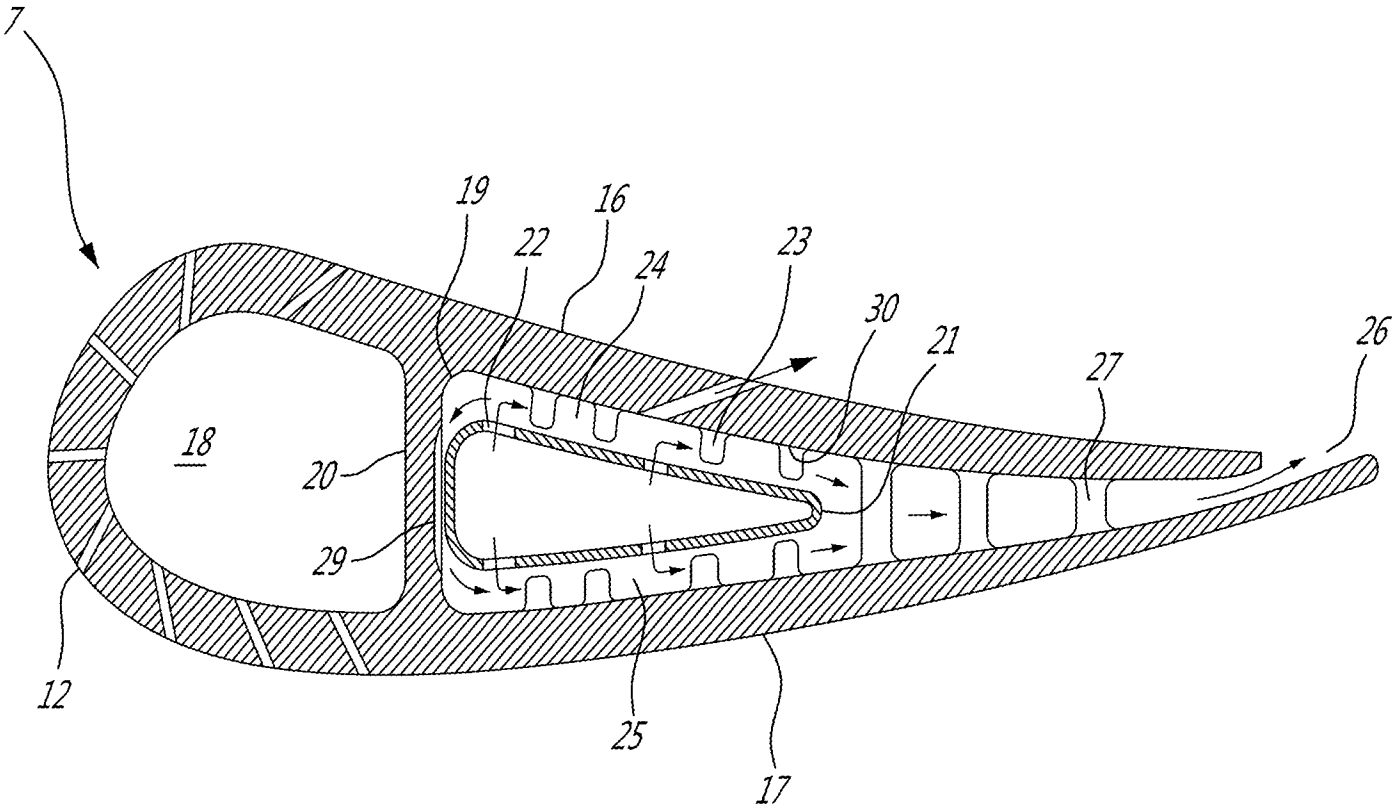
FIG. 5 is a transverse-axial sectional view through a hollow vane in accordance with an embodiment showing an air flow channel between the front surface of the insert and the rear surface of the dividing wall (dividing rear and front sections of the hollow vane) where the channel serves to convey air from the pressure side chamber and the suction side chamber as indicated by arrows (at left as drawn).
Figure 6:
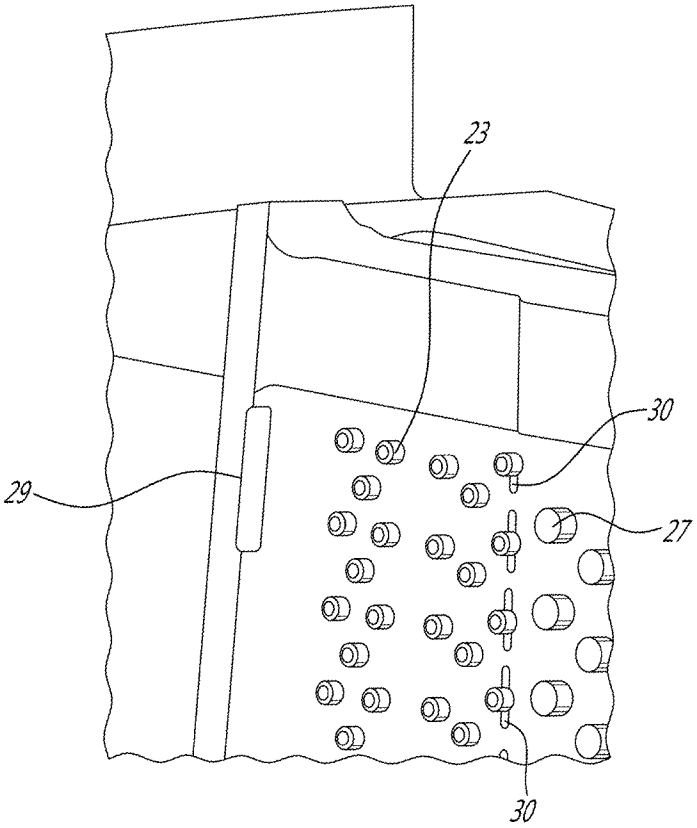
FIG. 6 is a fragmentary detail of a radial-axial sectional view showing the channel, protrusions, pedestals, and also showing a radial row of modified protrusions having radially extending aerodynamic trips to throttle the air flow, create a back pressure and urge cooling air flow through the channel and towards the suction side chamber.
Figure 7:
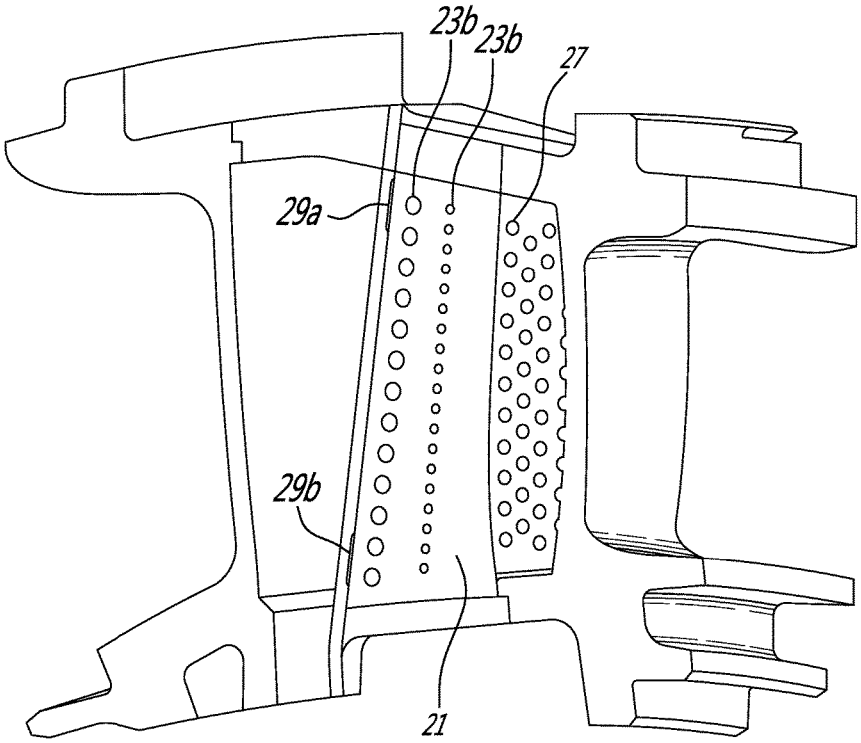
FIG. 7 is a sectional view, similar to FIG. 3, but through the hollow vane of the example in FIGS. 5-6 showing two channels in the dividing wall (radially inner and outer channels at bottom and top as drawn). An insert is shown with insert impingement holes.

FIG. 5 illustrates an example where the rear surface of the dividing wall 20 includes an air flow channel 29 communicating between the pressure side chamber 24 and the suction side chamber 25. FIG. 6 shows a fragmentary view of a radially outer channel 29. FIG. 7 shows two channels 29, being a radially outer channel 29*a* and a radially inner channel 29*b*. The depth of the channels 29 may be in the order of 0.010 inches and together with the gap 28 of 0.005 inches, the total maximum spaced apart distance may be 0.015 inches in the area of the channels 29.

The locations of the two channels 29 in FIG. 7 are selected to direct additional air flow towards the areas 14 of lower gas path temperature as shown in FIG. 2. As indicated with arrows in FIG. 5, a portion of the cooling air within the pressure side chamber 24 is directed through the channel 29 to the suction side chamber 25 by a pressure differential between the chambers 24, 25. Since this portion of cooling air has been heated by residence within the pressure side chamber 24, relative to the air that is fed directly through openings 22 into the suction side chamber 25, the portion passing through the channel(s) 29 is of a higher temperature. This portion of compressed cooling air is directed towards the areas 14 of lower gas path temperature shown in FIG. 2, thereby reducing the variation in the temperature gradient adjacent the trailing edge 13 of the vane 7.

FIGS. 5-6 illustrate a further means by which the air pressure within the pressure side chamber 24 is increased relative to the suction side chamber 25, namely by throttling or restricting of air flow between the pressure side chamber 24 and the trailing edge outlet 26. In the illustrated example, air flow trips 30 extend radially from the protrusions 23 and restrict air flow exiting from the pressure side chamber 24. Air flow is directed through the channels 29 to the suction side chamber 25 by the throttling or restriction created by the trips 30 and the resultant pressure differential. Various other throttling means can be used to impose a flow restriction as described below.

Figure 8:
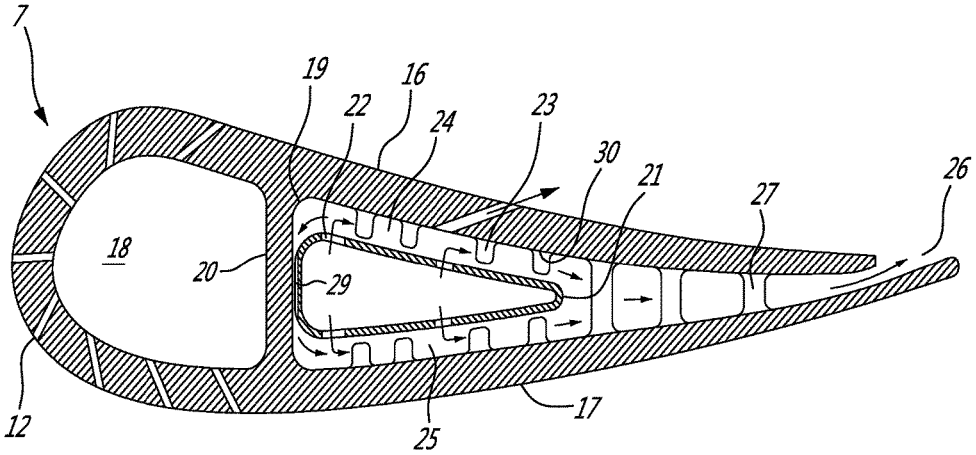
FIG. 8 is a transverse-axial sectional view through a hollow vane illustrating a recess defined in a front face of an insert to create a channel between a pressure side chamber and a suction side chamber.

To reiterate, the turbine vane 7, illustrated in FIGS. 5-7, includes at least one air flow channel 29 comprising a recess molded or otherwise formed within the rear surface of the dividing wall 20. An alternative example is shown in FIG. 8, wherein the single channel 29 or two channels 29 radially spaced apart comprise a recess or dimple within the front surface of the insert 21. In the example shown in FIG. 7, the two channels 29 can be disposed adjacent an outer end and an inner end of the interior radially extending passage of the turbine vane 7. The channels 29 are upstream from areas 14 on the suction side 17 of the turbine vane 7 that are exposed to lower gas path temperatures relative to higher gas path temperatures of a central region of the vane 7.

Throttling means between the pressure side chamber 24 and the trailing edge outlet 26 can include radially extending aerodynamic trips 30 at the downstream end of the pressure side chamber 24 as shown in FIGS. 6-7. Alternatively, as in FIG. 7, the throttle can include pins 23*b* adjacent an upstream or downstream portion of the pressure side chamber 24 having a larger radial dimension relative to a radial dimension of upstream protrusions 23. Further alternative throttle or flow restricting features include: radially extending pedestals 27; and axially extending ribs (not shown), disposed upstream of the trailing edge outlet 26 and downstream of the pressure side chamber 24.

Although the above description relates to a specific preferred embodiment as presently contemplated by the inventors, it will be understood that the invention in its broad aspect includes mechanical and functional equivalents of the elements described herein.

We claim:

1. A turbine vane comprising:

a pressure side; a suction side; and a hollow front section separated from a hollow rear section by a dividing wall;

the hollow rear section having interior walls spaced apart from a hollow insert by stand-offs to define a pressure side chamber and a suction side chamber, the hollow insert being separate from the interior walls and independently positioned in the hollow rear section;

the hollow insert adapted to be in fluid communication with a source of pressurized cooling air and having openings for conveying cooling air into the pressure side chamber and the suction side chamber, the hollow insert being tubular and having a closed downstream end, the pressure side chamber and the suction side chamber merging in flow communication at the closed downstream end of the hollow insert;

a front surface of the hollow insert and a rear surface of the dividing wall being spaced apart defining a gap; and at least one of: a) the front surface of the hollow insert or b) the rear surface of the dividing wall, having a channel formed therein, the channel communicating between the pressure side chamber and the suction side chamber.

2. The turbine vane according to claim 1, wherein the channel comprises a recess formed within the rear surface of the dividing wall.

3. The turbine vane according to claim 1, wherein the channel comprises a dimple within the front surface of the insert.

4. The turbine vane according to claim 1, comprising two channels radially spaced apart.

5. The turbine vane according to claim 4, wherein the two channels are disposed at radially opposed end portions of the vane.

6. The turbine vane according to claim 5, wherein the two channels are disposed upstream from regions on the suction side of the turbine vane that are exposed to lower gas path temperatures relative to higher gas path temperatures of a central region.

7. The turbine vane according to claim 1, comprising a throttle in the pressure side chamber.

8. The turbine vane according to claim 7, wherein the throttle comprises radially extending aerodynamic trips located in a downstream portion of the pressure side chamber.

9. The turbine vane according to claim 7, wherein the throttle comprise pins adjacent one of: an upstream; and a downstream portion, of the pressure side chamber having a larger radial dimension relative to a radial dimension of the stand-offs.

10. The turbine vane according to claim 7, wherein the throttle comprises one of: radially extending pedestals; and axially extending ribs, disposed at a downstream end of the pressure side chamber.

11. An internally cooled turbine vane comprising:

a pressure side; a suction side; and a radially extending passage defined between the pressure side and the suction side, the radially extending passage defined by interior walls of the vane;

an insert separately positioned in the radially extending passage and defining therewith a pressure side chamber and a suction side chamber, the insert having a tubular body with a closed downstream end, the pressure side chamber and the suction side chamber merging in flow communication at the closed downstream end of the insert, the tubular body spaced from the interior walls by stand-offs;

a front surface of the insert and/or one of the interior walls of the vane that faces the front surface of the insert having at least one channel formed therein, the at least one channel communicating between the pressure side chamber and the suction side chamber; and a flow restrictor for directing a portion of a coolant within the pressure side chamber through the at least one channel to the suction side chamber by a pressure differential between the pressure and suction side chambers, the flow restrictor configured to increase air pressure in the pressure side chamber to a value greater than the air pressure in the suction side chamber.

12. The internally cooled turbine vane according to claim 11, wherein the at least one channel comprises a recess formed within a surface of an internal dividing wall of the internally cooled turbine vane.

13. The internally cooled turbine vane according to claim 11, wherein the at least one channel comprises a dimple within a front surface of the insert.

14. The internally cooled turbine vane according to claim 11, wherein the at least one channel comprises two channels radially spaced apart.

15. The internally cooled turbine vane according to claim 14, wherein the two channels are disposed adjacent an outer end and an inner end of the radially extending passage of the internally cooled turbine vane.

16. The internally cooled turbine vane according to claim 15, wherein the two channels are disposed upstream from regions on the suction side of the internally cooled turbine vane that are exposed to lower gas path temperatures relative to higher gas path temperatures of a central region.

17. The internally cooled turbine vane according to claim 11, wherein the flow restrictor comprise a throttle between the pressure side chamber and a trailing edge outlet.

18. The internally cooled turbine vane according to claim 17, wherein the throttle comprise radially extending aerodynamic trips at a downstream end of the pressure side chamber.

19. The internally cooled turbine vane according to claim 17, wherein the throttle comprises protrusions adjacent one of: an upstream; and a downstream portion, of the pressure side chamber having a larger radial dimension relative to a radial dimension of other protrusions.

20. The internally cooled turbine vane according to claim 17, wherein the throttle comprises one of: radially extending pedestals; and axially extending ribs, disposed upstream of the trailing edge outlet inside the pressure side chamber.

21. An internally cooled turbine vane comprising:

a pressure side; a suction side; and a radially extending passage defined between the pressure side and the suction side, the radially extending passage defined by interior walls of the vane;

an insert separately positioned in the radially extending passage and defining therewith a pressure side chamber and a suction side chamber, the insert having a tubular body with a closed downstream end, the pressure side chamber and the suction side chamber merging in flow communication at the closed downstream end of the insert, the tubular body spaced from the interior walls by stand-offs, the stand-offs extending along longitudinal axes between the interior walls and the tubular body;

at least one channel communicating between the pressure side chamber and the suction side chamber; and a flow restrictor for directing a portion of a coolant within the pressure side chamber through the at least one channel to the suction side chamber by a pressure differential between the pressure and suction side chambers, the flow restrictor configured to increase air pressure in the pressure side chamber to a value greater than the air pressure in the suction side chamber, the flow restrictor including aerodynamic trips, the aerodynamic trips secured to the stand-offs and extending radially therefrom relative to the longitudinal axes.

22. The internally cooled turbine vane of claim 21, wherein the aerodynamic trips extend parallel to a longitudinal axis of the tubular body of the insert.

* * * * *